US007766002B2

(12) United States Patent
Karau et al.

(10) Patent No.: US 7,766,002 B2
(45) Date of Patent: Aug. 3, 2010

(54) CONCRETE BLOCK SPLITTING AND PITCHING APPARATUS

(75) Inventors: William Howard Karau, Southlake, TX (US); Joerg Marx, Grapevine, TX (US); Tommy W. Davis, Argyle, TX (US)

(73) Assignee: Pavestone Company, L.P., Dallas, TX (US)

( * ) Notice: Subject to any disclaimer, the term of this patent is extended or adjusted under 35 U.S.C. 154(b) by 338 days.

(21) Appl. No.: 11/583,194

(22) Filed: Oct. 18, 2006

(65) Prior Publication Data

US 2008/0092870 A1 Apr. 24, 2008

(51) Int. Cl.
*B28D 1/26* (2006.01)

(52) U.S. Cl. ..... 125/23.01; 125/40; 225/96; 225/103; 225/104

(58) Field of Classification Search ..... 125/23.01, 125/24, 40; 225/94, 96, 96.5, 103, 104, 105
See application file for complete search history.

(56) References Cited

U.S. PATENT DOCUMENTS 1,366,063 A * 1/1921 Culhane, Jr. ..... 225/2
1,534,353 A 4/1925 Besser
1,872,522 A 8/1932 Stuckey
4,131,223 A * 12/1978 Aureli ..... 225/94
4,335,549 A 6/1982 Dean, Jr.
4,627,764 A 12/1986 Scheiwiller
4,973,192 A 11/1990 Hair (Continued)

FOREIGN PATENT DOCUMENTS

GB 948121 1/1964

OTHER PUBLICATIONS

"Haith Robot System for Aggregate Industries," http://www.hub-4.com/news/109/haith-robot-system-for-aggreqate-industries, Jul. 31, 2006.

(Continued)

*Primary Examiner*—Timothy V Eley
(74) *Attorney, Agent, or Firm*—Jackson Walker L.L.P.; Christopher J. Rourk

(57) ABSTRACT

An apparatus for pitching and splitting a masonry block is provided. The apparatus includes a first pitching blade configured to move in a first direction. A second pitching blade is disposed adjacent to the first pitching blade, and the two pitching blades are separated by a distance that is small enough so that the splits initiated by each blade join into a single plane, thereby pitching and splitting the masonry block without the need for a splitting blade.

20 Claims, 7 Drawing Sheets

U.S. PATENT DOCUMENTS

| | | | | |
|---|---|---|---|---|
| D315,026 | S | 2/1991 | Castonguay et al. | |
| 5,487,526 | A | 1/1996 | Hupp | |
| D377,181 | S | 1/1997 | Hupp | |
| D378,702 | S | 4/1997 | Blomquist et al. | |
| 5,733,470 | A | 3/1998 | Roth et al. | |
| 5,827,015 | A | 10/1998 | Woolford et al. | |
| 5,884,445 | A | 3/1999 | Woolford | |
| 6,029,943 | A | 2/2000 | Sievert | |
| 6,142,713 | A | 11/2000 | Woolford et al. | |
| D442,703 | S | 5/2001 | Fifield | |
| D448,861 | S | 10/2001 | Daniels et al. | |
| 6,401,707 | B1 * | 6/2002 | Fladgard et al. | 125/23.01 |
| 6,668,816 | B1 | 12/2003 | Pedersen et al. | |
| D505,733 | S | 5/2005 | Castonguay et al. | |
| 6,886,551 | B2 * | 5/2005 | Scherer et al. | 125/23.01 |
| 6,918,715 | B2 | 7/2005 | Scherer et al. | |
| 6,964,272 | B2 * | 11/2005 | Scherer | 125/23.01 |
| 7,004,158 | B2 * | 2/2006 | Scherer et al. | 125/23.01 |
| 7,055,517 | B1 | 6/2006 | Kitahara | |
| 7,066,167 | B2 * | 6/2006 | Scherer et al. | 125/23.01 |
| 7,146,974 | B2 * | 12/2006 | Scherer | 125/23.01 |
| 7,179,214 | B2 * | 2/2007 | Kitahara | 483/16 |
| 7,428,900 | B2 * | 9/2008 | Scherer | 125/23.01 |
| 2006/0054154 | A1 | 3/2006 | Scherer | |

OTHER PUBLICATIONS

"Reconstructed Stone—Stone Pitchers," http://www.haithindustrial.co.uk/index.php?sec=cont&id=26, Jul. 31, 2006.

"Natural Stone—Block and Slab Splitting," http://www.haithindustrial.co.uk/index.php?sec=cont&id=32, Jul. 31, 2006.

"Splitting, Cutting, Marking & Layout," http://www.pavetech.com/newtools/cutting.shtm, Jul. 31, 2006.

"Stone Splitter," http://www.pavetech.com/newtools/stonesplitter.shtm, Jul. 31, 2006.

"Splitters/Turnovers," http://www.besser.com/equipment/splitters/, Aug. 3, 2006.

"Split-Face Concrete Block," http://www.toolbase.org/Technology-Inventory/walls/split-face-concrete-block, Aug. 3, 2006.

* cited by examiner

CONCRETE BLOCK SPLITTING AND PITCHING APPARATUS

RELATED APPLICATIONS

This application is related to U.S. application Ser. No. 11/583,592, entitled "CONCRETE BLOCK SPLITTING AND PITCHING APPARATUS AND METHOD," and U.S. application Ser. No. 10/182,006, entitled "MASONRY BLOCK MULTI-SPLITTING APPARATUS AND METHOD," commonly owned, filed herewith and incorporated by reference for all purposes.

FIELD OF THE INVENTION

The present invention pertains to the field of concrete block manufacturing, and more specifically to a concrete block splitting and pitching apparatus and method for splitting a concrete block into two or more sections and pitching the edges of the sections in a single step, using only pitching blades.

BACKGROUND OF THE INVENTION

Prior art systems and methods for manufacturing concrete blocks have included splitting devices that use two or more diametrically-opposed blades in a press, where the blades cause the concrete block to split into two parts. Some of the prior art concrete block splitters further include ridges or projections to create random variations on the concrete block, so as to manufacture a plurality of blocks that do not appear to be identical, to simulate a hand-made or naturally-occurring block.

In addition, prior art systems and methods have included pitching devices that pitch the edges of a concrete block. These pitching devices are also used to create random variations to simulate hand-made or naturally-occurring block. As such, the prior art concrete block manufacturing systems and methods teach away from creation of features on a concrete block in a controlled manner.

SUMMARY OF THE INVENTION

In accordance with the present invention, a concrete block splitting and pitching apparatus and method are provided that allow a concrete block to be split and pitched in a single step.

In particular, a system and method for splitting and pitching a concrete block are provided that allow the pitching of the concrete block to be controlled so as to create controlled features on the pitched surface.

In accordance with an exemplary embodiment of the present invention, an apparatus for pitching and splitting a masonry block is provided. The apparatus includes a first pitching blade configured to move in a first direction. A second pitching blade is disposed adjacent to the first pitching blade, and the two pitching blades are separated by a distance that is small enough so that the splits initiated by each blade join into a single plane, thereby pitching and splitting the masonry block without the need for a splitting blade.

The present invention provides many important technical advantages. One important technical advantage of the present invention is an apparatus and method for splitting and pitching a concrete block that allows the concrete block to be split and pitched in a single step using two pitching blades only, so as to create a pitched edge on a split face of a masonry block without the need for a splitting blade.

Those skilled in the art will further appreciate the advantages and superior features of the invention together with other important aspects thereof on reading the detailed description that follows in conjunction with the drawings.

DETAILED DESCRIPTION OF PREFERRED EMBODIMENTS

Figure 1:
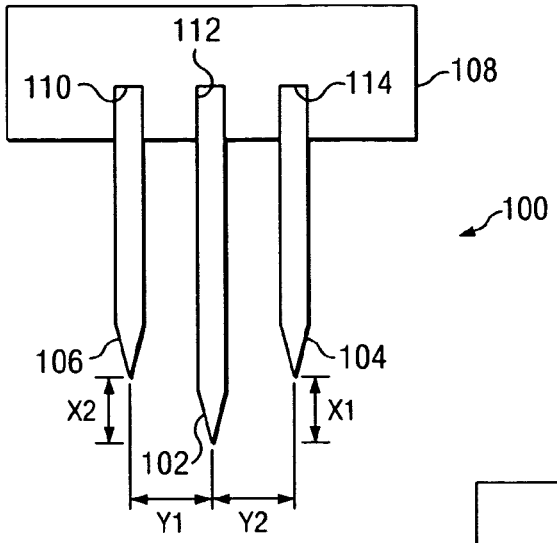
FIG. 1 is a diagram of an edge view of a blade assembly in accordance with an exemplary embodiment of the present invention.

In the description that follows, like parts are marked throughout the specification and drawings with the same reference numerals. The drawing figures might not be to scale and certain components can be shown in generalized or schematic form and identified by commercial designations in the interest of clarity and conciseness.

FIG. 1 is a diagram of an edge view of a blade assembly 100 in accordance with an exemplary embodiment of the present invention. Blade assembly 100 allows a block, such as one formed from concrete, masonry, or other suitable materials (all hereinafter referred to in general as a concrete block) to be split and pitched in a single step, as opposed to requiring multiple steps and stations for splitting and pitching.

Blade assembly 100 includes splitting blade 102 and pitching blades 104 and 106. Each of splitting blade 102 and pitching blades 104 and 106 are secured in grooves 112, 114 and 110, respectively, of blade holder 108, which can be an interchangeable blade holder assembly, a static blade holder assembly that is part of a larger cutting machine, or other suitable blade assemblies. In one exemplary embodiment, pins, screws, clamps, or other suitable devices or materials can be used to secure splitting blade 102 in groove 112 and pitching blades 104 and 106 in grooves 114 and 110, respectively. The shape of splitting blade 102 and pitching blades 104 and 106 can likewise be altered, such as to interlock with grooves 112, 114 and 116, respectively, or for other suitable purposes.

Splitting blade 102 and pitching blades 104 and 106 are made from suitable material for splitting concrete blocks, such as steel or other suitable blade material. Pitching blades 104 and 106 are inset a distance "X1" and "X2," respectively, from splitting blade 102, such that when blade holder 108 is moved towards the concrete block to be split and pitched, splitting blade 102 encounters the concrete block first and causes the block to split. Pitching blades 104 and 106 then encounter the block after it has been split so as to cause the split edge of the block to be pitched. Furthermore, splitting blade 102 can be used to affect the action of pitching blades 104 and 106, such as by increasing the height difference "X1" and "X2" so that splitting blade 102 applies a force against the split face of the concrete block. In this exemplary embodiment, the spacings "X1," "X2," "Y1" and "Y2" as shown can be varied as suitable to create different pitch depths, spacing, to decrease the amount of force required to perform the pitching and splitting operations, to control the quality of the pitching and splitting operations so as to reduce random variations in the split or pitched surfaces, or for other suitable purposes.

Splitting blade 102 and pitching blades 104 and 106 can be removed to allow them to be replaced, such as to modify the height difference "X1" or "X2," the spacing "Y1" or "Y2," to replaced blades after they have been damaged or worn, or for other suitable purposes. Further variations of exemplary pitching blades 104 and 106 are shown in side view in FIGS. 2, 5, 6 from the view as shown in FIG. 1.

In operation, blade assembly 100 is used in conjunction with other blade assemblies to split a concrete block and to pitch the resulting edges in a single combined splitting and pitching operation. The separation "Y1" and "Y2" between the plane of splitting blade 102 and the planes of pitching blades 104 and 106, respectively, and "X1" and "X2" between the edge of splitting blade 102 and between the edge of pitching blades 104 and 106, respectively, can be varied to control the quality of the pitched edge that is formed after splitting. In one exemplary embodiment, the width of splitting blade 102 can be controlled so as to separate the segments of the split concrete block so as to prevent interference between the segments as they are split, which can create random variations that might not be desired. Other suitable variations described herein can also or alternatively be used to control the pitching of edges after splitting.

Figure 2:
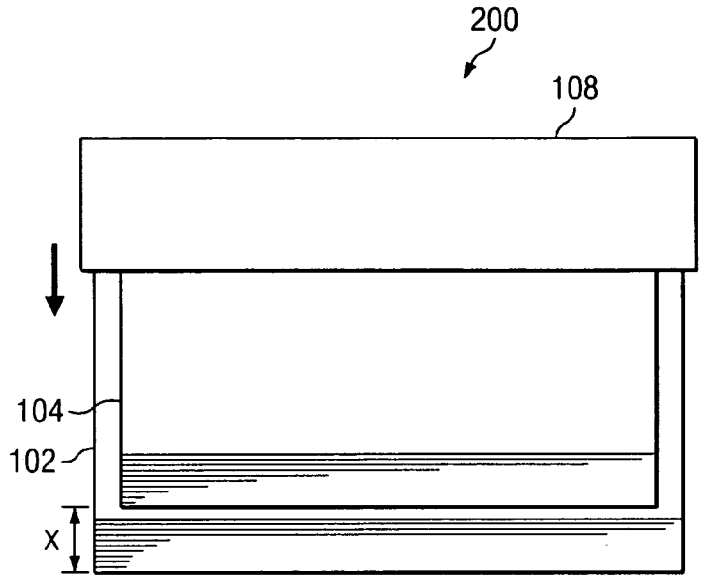
FIG. 2 is a diagram of a side view of a blade assembly in accordance with an exemplary embodiment of the present invention.

FIG. 2 is a diagram of a side view of blade assembly 200 in accordance with an exemplary embodiment of the present invention. Blade assembly 200 includes splitting blade 102 and pitching blade 104. Splitting blade 102 and pitching blade 104 are held by blade holder 108. In addition, the offset "X1" between splitting blade 102 and pitching blade 104 is shown in FIG. 2.

In operation, blade assembly 200 is moved towards a concrete block in the direction of the arrow to split the concrete block and to pitch the edges of the concrete block in a single step. In one exemplary embodiment, blade assembly 200 can be part of a hydraulic, pneumatic, electric or mechanical press that simultaneously moves blade assembly 200 down onto the concrete block to be split, two other blade assemblies sideways against the concrete block, and one additional blade assembly upwards against the concrete block. When blade assembly 200 is used for each blade assembly, each edge of the two block pieces that are formed from the concrete block that is being split can be pitched. The pitched surface created using blade assembly 200 can be controlled to have predetermined characteristics based on the orientation of splitting blade 102 and pitching blade 104, such as by increasing the planar separation "Y2" or the edge height separation "X1" as shown in FIG. 1.

Figure 3:
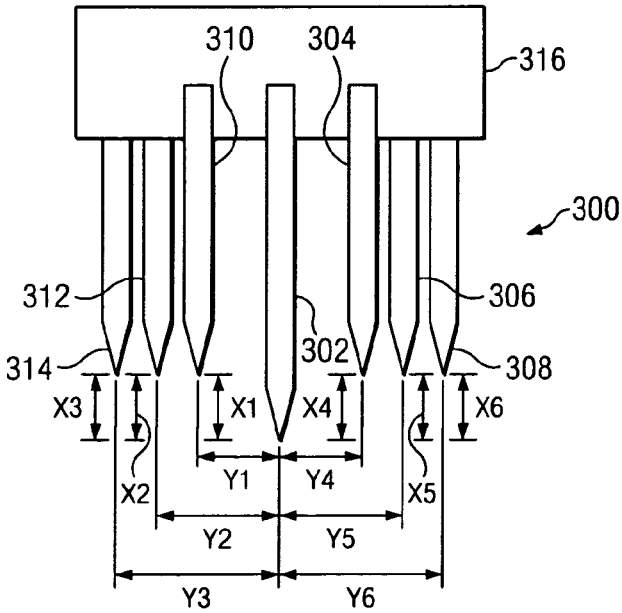
FIG. 3 is a diagram of an edge view of a blade assembly with parallel staggered blades in accordance with an exemplary embodiment of the present invention.

FIG. 3 is a diagram of an edge view of blade assembly 300 with parallel staggered blades in accordance with an exemplary embodiment of the present invention. Blade assembly 300 includes splitting blade 302 and pitching blades 304, 306, 308 and 310, 312, and 314. Each of the splitting and pitching blades are held by blade holder 316 in corresponding slots. As shown, pitching blades 304, 306, 308 and pitching blades 310, 312, and 314 are parallel to and staggered from each other so as to create a staggered pitching effect. A side view of the arrangement of splitting blade 302 and pitching blades 304, 306, and 308 is shown in FIG. 4.

In addition, pitching blades 304, 306, 308 and pitching blades 310, 312, and 314 are separated from splitting blade 302 by a distance of Y4, Y5, Y6, Y1, Y2 and Y3, respectively, and the cutting edge of pitching blades 304, 306, 308 and pitching blades 310, 312, and 314 are separated from the cutting edge of splitting blade 302 by a distance of X4, X5, X6, X1, X2 and X3, respectively. In this manner, the separation between the pitching blades and the splitting blade can be controlled so as to reduce the amount of force required to split and pitch the concrete block, to control the pitching of the concrete block edges after splitting so as to eliminate unwanted random variations, and for other suitable purposes.

Figure 4:
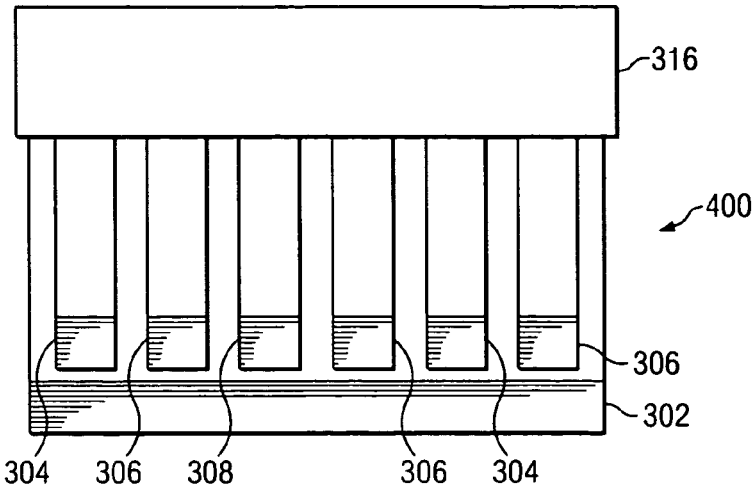
FIG. 4 is a diagram of a side view of a blade assembly with parallel and axially staggered blades in accordance with an exemplary embodiment of the present invention.

FIG. 4 is a diagram of a side view of blade assembly 400 with parallel and axially staggered blades in accordance with an exemplary embodiment of the present invention. Blade assembly 400 includes splitting blade 302 and pitching blades 304, 306 and 308, each of which is held by blade holder 316. As shown in FIG. 3, pitching blade 304 is parallel to and axially offset from splitting blade 302 by a different amount than the axial offset of pitching blades 306 and 308, which are also parallel to splitting blade 302. In this manner, an axially-scalloped pitching effect can be created on each block that is split and pitched using blade assembly 400.

Figure 5:
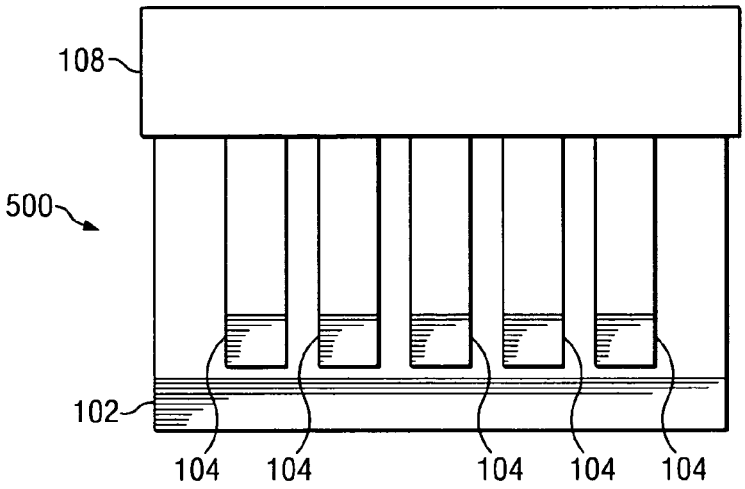
FIG. 5 is a diagram of a side view of a blade assembly with aligned parallel blades in accordance with an exemplary embodiment of the present invention.

FIG. 5 is a diagram of a side view of blade assembly 500 with aligned parallel blades in accordance with an exemplary embodiment of the present invention. Blade assembly 500 includes splitting blade 102, pitching blades 104, and blade holder 108. Unlike blade assembly 400, which has a plurality of pitching blades that are axially staggered, the pitching blades of blade assembly 500 are not axially offset but lie alongside the same horizontal axis. In this manner, the pitching cuts made by pitching blades 104 do not form an axially-scalloped pitching effect, and the scalloped pitching effect created by blade assembly 500 might result in some random variations that cause concrete blocks created using blade assembly 500 to contain certain desired random variations while retaining a scalloped effect.

Figure 6:
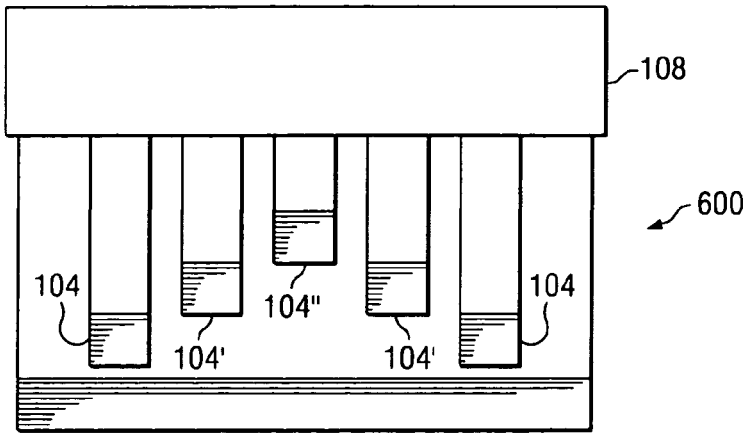
FIG. 6 is a diagram of a blade assembly with vertically staggered blades in accordance with an exemplary embodiment of the present invention.

FIG. 6 is a diagram of blade assembly 600 with vertically staggered blades in accordance with an exemplary embodiment of the present invention. Blade assembly 600 includes splitting blade 102 and pitching blades 104, 104' and 104", each of which are held by blade holder 108. Although the edge view of FIG. 1 necessarily obscures the vertical variations in the height of blades 104, 104' and 104", FIG. 6 shows these vertical variations, which can be used to create a controlled and axially-aligned scalloped pitching effect on the edges of a concrete block after it has been split by splitting blade 102 of blade assembly 600. Likewise, by vertically staggering the height of pitching blades 104, 104' and 104", the amount of force required to split and pitch the concrete block can be decreased, such as where it is desirable to reduce the amount of force that is required to split and pitch concrete blocks in order to meet machine press design loading, to conserve power, or for other suitable purposes.

Figure 7:
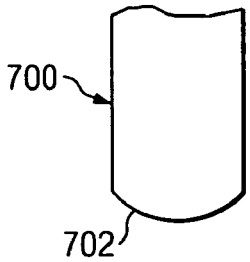
FIG. 7 is a diagram of a pitching blade with a crown in accordance with an exemplary embodiment of the present invention.

FIG. 7 is a diagram of pitching blade 700 with a crown in accordance with an exemplary embodiment of the present invention. Pitching blade 700 includes crown 702 that rises to a peak in the center of pitching blade 700. In this manner, the force required to pitch the block being operated on is decreased by focusing the force at the maximum height of crown 702. Pitching blade 700 also helps to reduce random variations that can result from a flat pitching blade, where the pitching action can start unevenly at various points along the length of the flat pitching blade.

Figure 8:
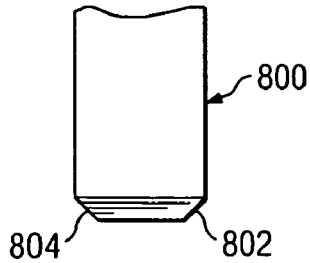
FIG. 8 is a diagram of a pitching blade with cornered edges in accordance with an exemplary embodiment of the present invention.

FIG. 8 is a diagram of pitching blade 800 with cornered edges in accordance with an exemplary embodiment of the present invention. Pitching blade 800 includes cornered edges 802 and 804. In this exemplary embodiment, providing a corner on cornered edges 802 and 804 can help to prevent cracking or other unintended effects on the concrete block section that has been split, which can create random variations in the appearance of the pitched surface.

Figure 9:
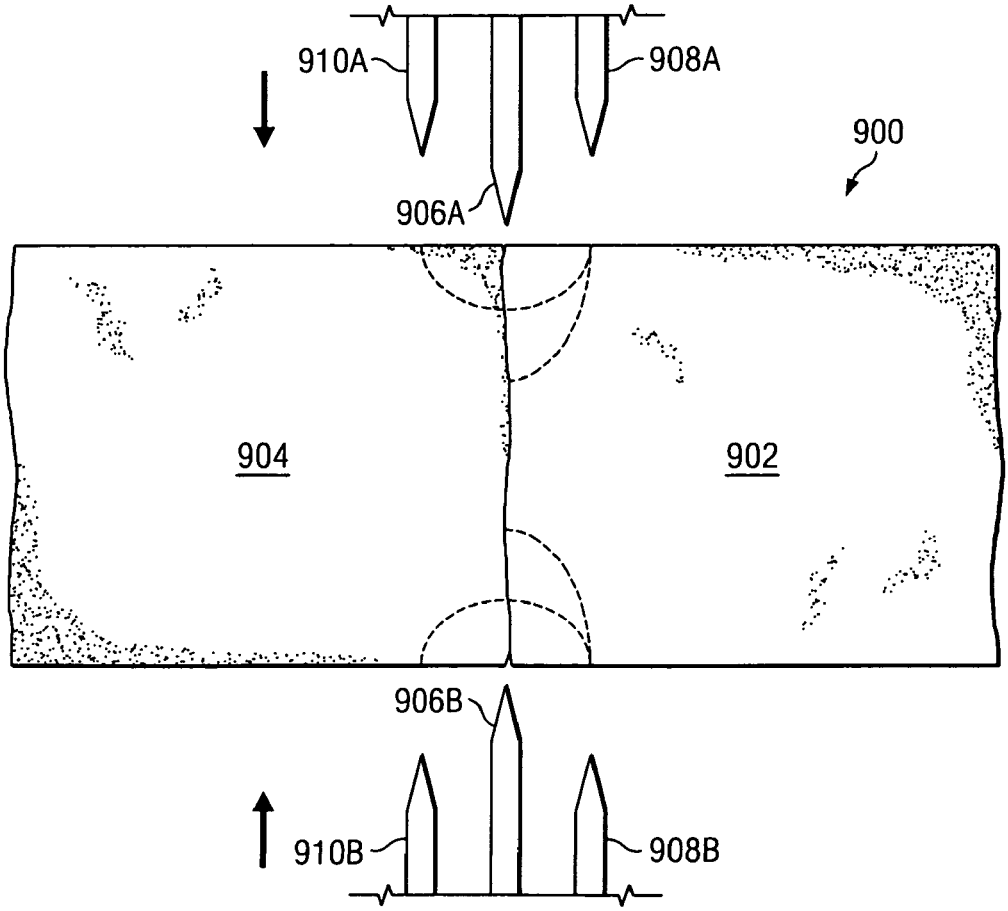
FIG. 9 is a diagram of a concrete block in accordance with an exemplary embodiment of the present invention.

FIG. 9 is a diagram of concrete block 900 in accordance with an exemplary embodiment of the present invention. Concrete block 900 is shown being split into two sections, 902 and 904. Splitting blades 906A and 906B are used to split concrete block 900 into sections 902 and 904 by impacting with the block before pitching blades 908A, 908B, 910A and 910B. Afterwards, pitching blades 908A and 908B on one side of the split and pitching blades 910A and 910B on the opposite side of the split interact with the block so as to pitch the edges of sections 902 and 904 at the split, shown as pitch break in FIG. 9. Two additional sets of splitting and pitching blades can also be used that move perpendicular to the direction of motion shown in FIG. 9. In this manner, a split concrete block having a pitched edge can be created in a single step.

As previously discussed, the spacing of splitting blades 906A and 906B relative to pitching blades 908A, 908B, 910A and 910B can also be varied so as to control the location of the pitch break. For example, if the difference in height between the splitting blades and the pitching blades is sufficient, the splitting blades will provide an axial force to the split face of each concrete block section that will cause the pitch break to elongate as shown. Even a slight difference in height between the splitting blades and the pitching blades will affect the dimensions of the pitch break, making the dimensions more controlled due only to the presence of pitching blades adjacent to the splitting blades and the presence of the newly-split concrete block sections adjacent to each other. In this manner, the dimensions of the pitch break are controlled not only by the pitching blades but also by the configuration of all of the blades in the blade assembly as well as the combined splitting and pitching operation that leaves the split concrete block sections adjacent to each other during the pitching operation.

Figure 10:
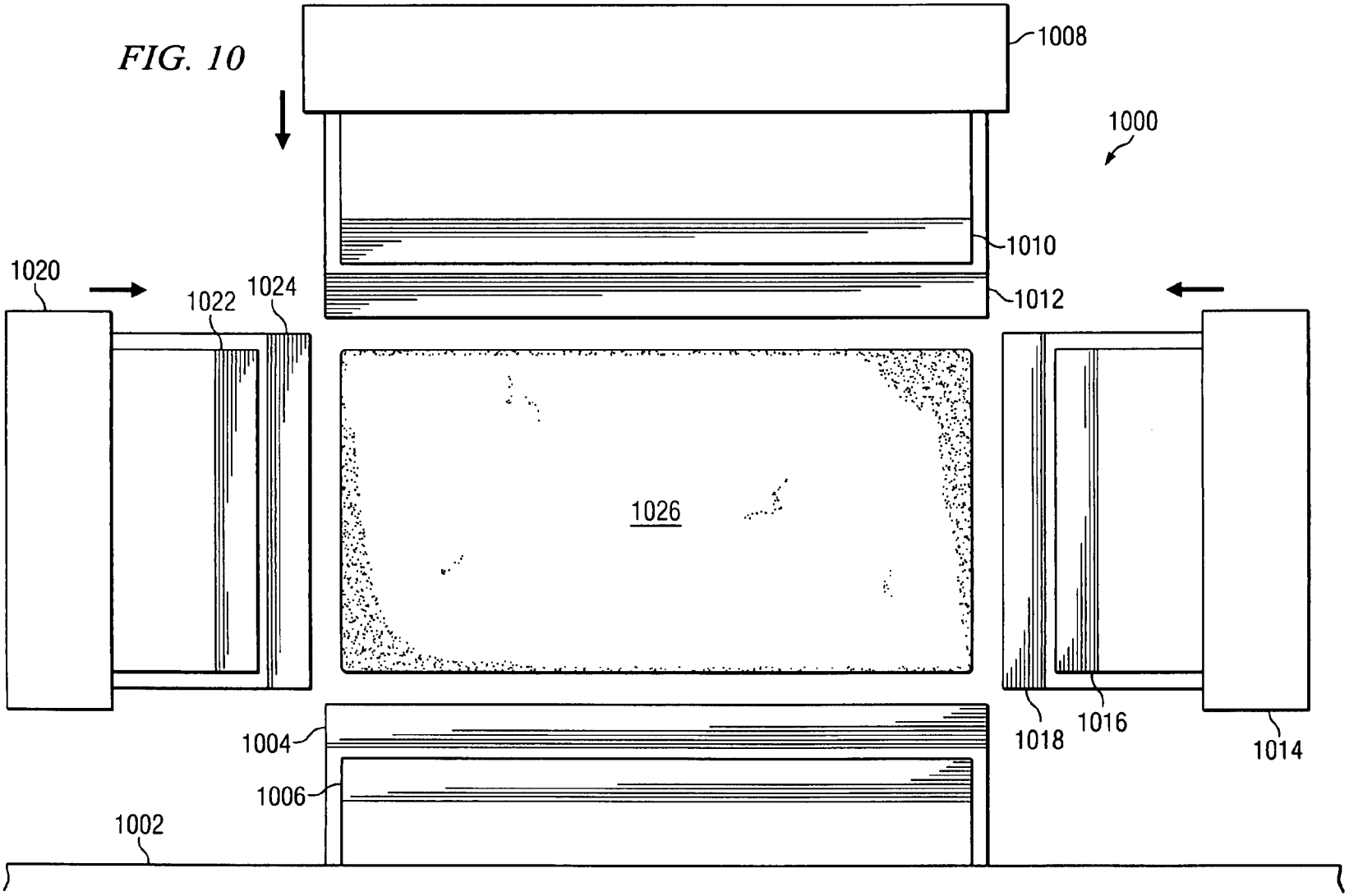
FIG. 10 is a diagram of a press in accordance with an exemplary embodiment of the present invention.

FIG. 10 is a diagram of press 1000 in accordance with an exemplary embodiment of the present invention. Press 1000 includes base 1002 which contains splitting blade 1004 and pitching blade 1006. Likewise, blade holder 1008 holds a corresponding splitting blade 1012 and pitching blade 1010. For splitting the block from the side and pitching the edges on the side, blade holder 1014 holds pitching blade 1016 and splitting blade 1018 and blade holder 1020 holds pitching blade 1022 and splitting blade 1024. Instead of the splitting and pitching blade configurations shown in FIG. 9, other suitable blade configurations, such as those shown herein or other suitable variations described herein, can also or alternatively be used.

In operation, blade holder 1008 is moved downwards, such as by a pneumatic press or other suitable presses capable of providing sufficient force to split concrete block 1026. Likewise, base 1002 can be recessed so as to hold concrete block 1026 up and can include movable splitting blade 1004 and pitching blade 1006 that can be raised, such as by a pneumatic press, in coordination with splitting blade 1012 and pitching blade 1010. In this manner, splitting blades 1012 and 1004 interact with concrete block 1026 so as to create a split through concrete block 1026.

Likewise, blade holders 1014 and 1020 are moved laterally so as to cause splitting blades 1018 and 1024 to interact with concrete block 1026 at the same time that splitting blades 1012 and 1004 interact with concrete block 1026 so to form a uniform split through concrete block 1026. After concrete block 1026 has been split by splitting blades 1004, 1012, 1018 and 1024, pitching blades 1006, 1010, 1016, and 1022 interact with concrete block 1026 so as to pitch the edges of concrete block 1026 along the split. In this manner, concrete block 1026 can be split into two blocks and the edges of each block can be pitched in a single action.

Figure 11:
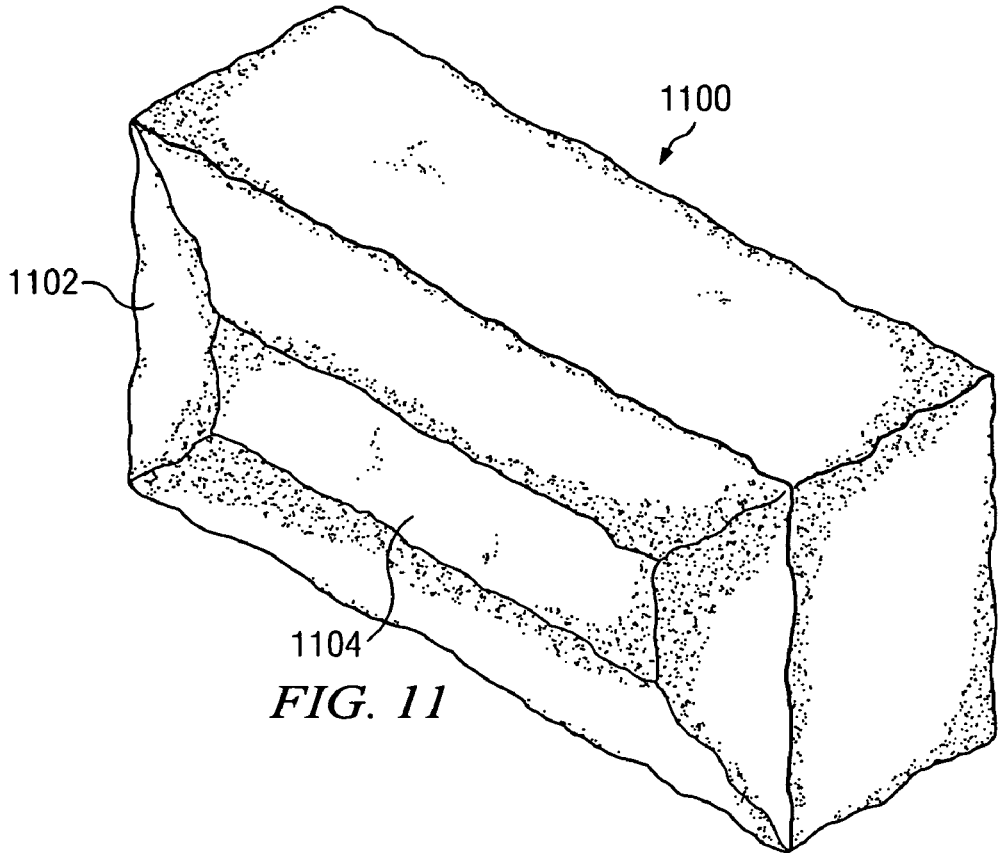
FIG. 11 is a diagram of a concrete block in accordance with an exemplary embodiment of the present invention.

FIG. 11 is a diagram of concrete block 1100 in accordance with an exemplary embodiment of the present invention. Concrete block 1100 includes pitched area 1102 and split face 1104. Pitched area 1102 is formed by pitching blades that are uniform along the length and sides of the splitting assembly. Split face 1104 is formed by splitting blades that are diametrically opposed to each other.

Figure 12:
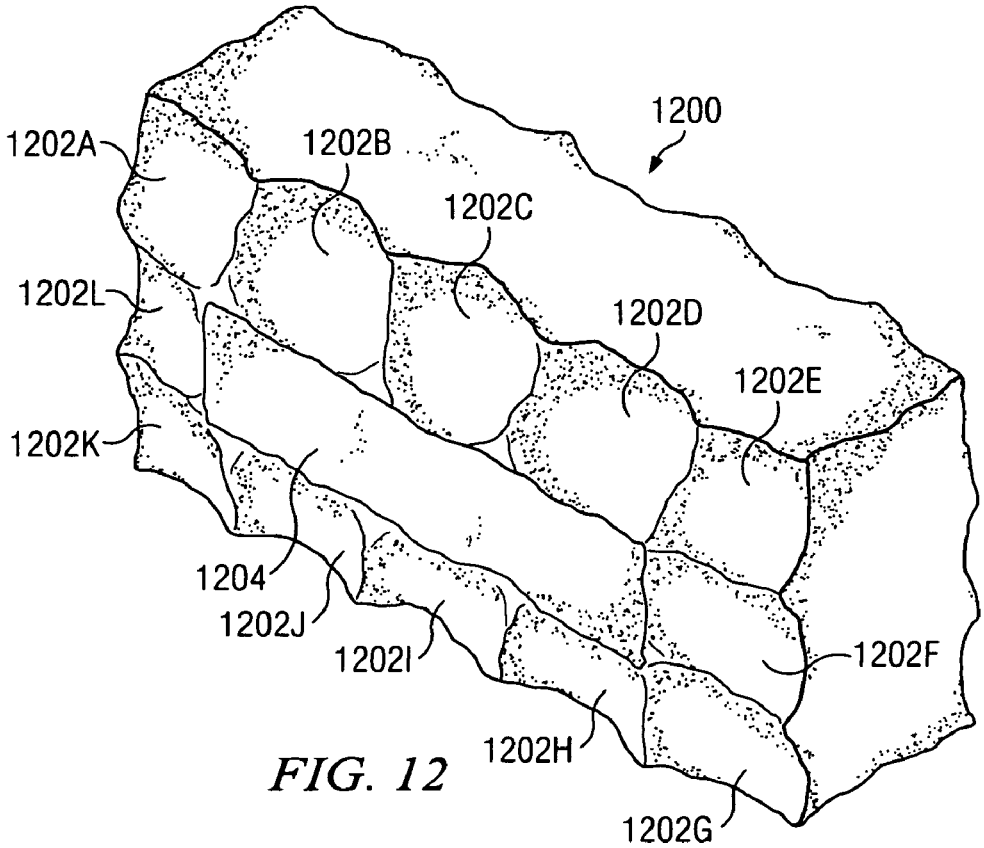
FIG. 12 is a diagram of a concrete block in accordance with an exemplary embodiment of the present invention.

FIG. 12 is a diagram of concrete block 1200 in accordance with an exemplary embodiment of the present invention. Concrete block 1200 includes scalloped sections 1202A through 1202L and split face 1204. As discussed previously, multiple pitching blades can be used to form scalloped sections 1202A through 1202L. By using pitching blades that are offset axially, scalloped sections 1202A through 1202L can be overlapped, or by aligning them and staggering the action of pitching blades by having different pitching blade heights, the scalloped sections can also be overlapped, uniform or can have other desired configurations.

Figure 13:
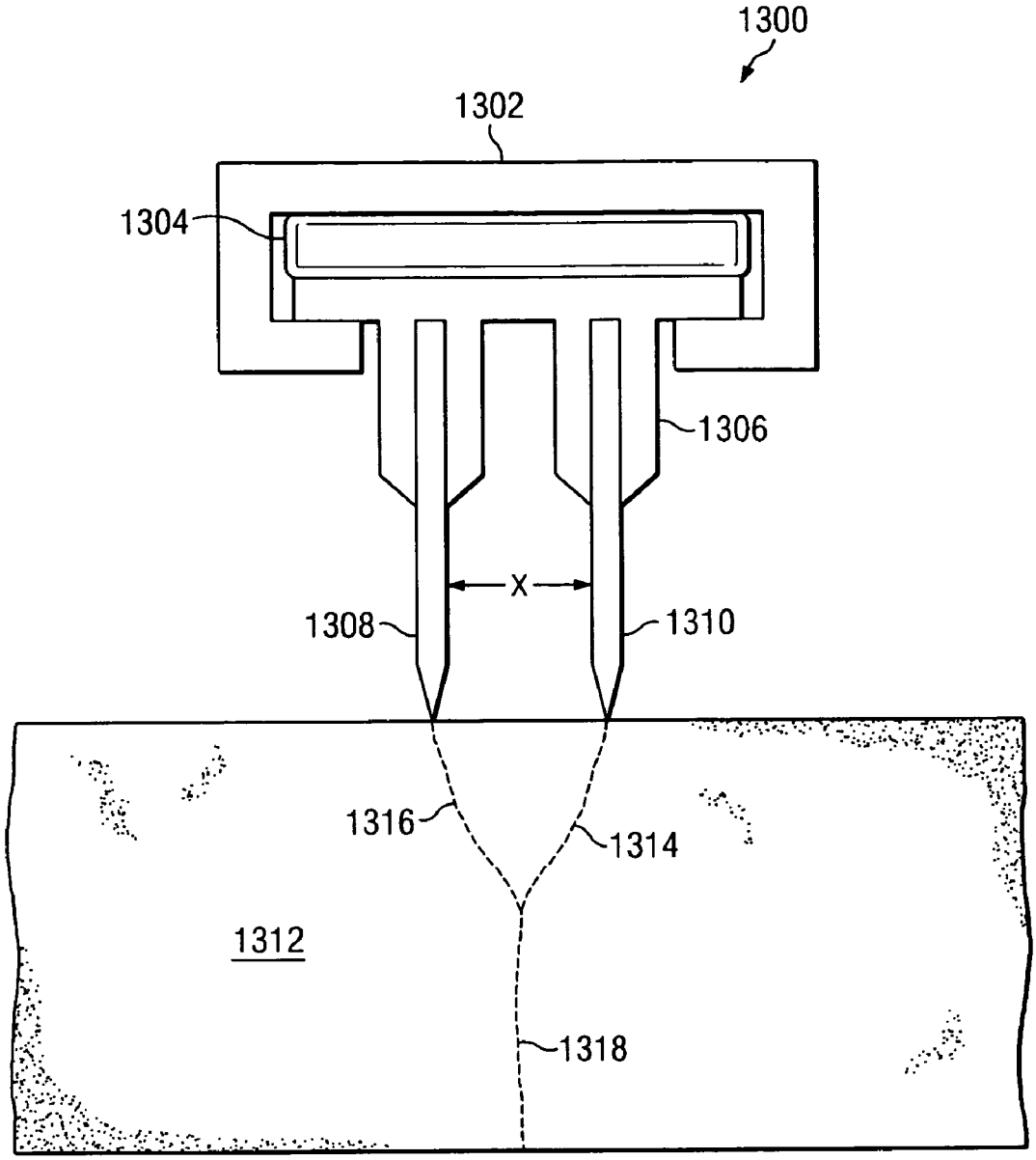
FIG. 13 is a diagram of a pitching blade assembly in accordance with an exemplary embodiment of the present invention.
Figure 14:
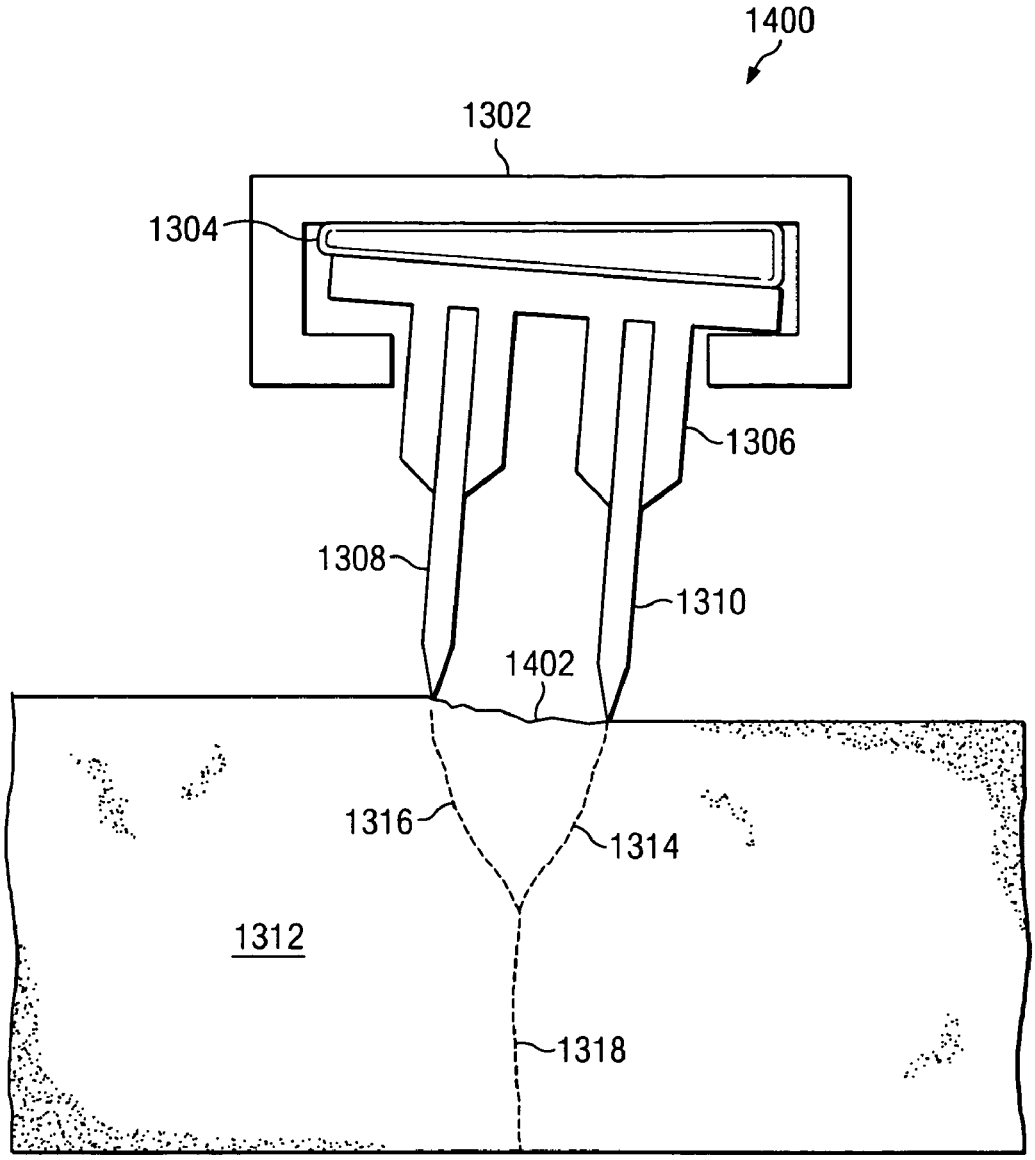
FIG. 14 is a diagram of a pitching blade assembly adjusting to a surface irregularity in accordance with an exemplary embodiment of the present invention.

FIG. 13 is a diagram of a pitching blade assembly 1300 in accordance with an exemplary embodiment of the present invention. Pitching blade assembly 1300 includes press 1302, compressible material 1304 and blade holder assembly 1306. Blade holder assembly 1306 includes two pitching blades 1308 and 1310, separated by a distance "X." If the distance "X" is less than the distance beyond which pitching blades 1308 and 1310 will operate as separate splitting blades, then pitch breaks 1314 and 1316 will form in concrete block 1312, and will propagate together to form split break 1318. The maximum separation distance will be a function of the material characteristics and dimensions of FIG. 14 is a diagram of a pitching blade assembly 1400 adjusting to a surface irregularity in accordance with an exemplary embodiment of the present invention. As shown, concrete block 1312 includes surface irregularity 1402, which causes pitching blades 1308 and 1310 to conform to the surface of concrete block 1312. Compressible material 1304 allows blade holder assembly 1306 to shift, so as to allow pitching blades 1308 and 1310 to conform to surface irregularity 1402 of concrete block 1312, which avoids improper propagation of pitch breaks 1314 and 1316.

Although exemplary embodiments of a system and method of the present invention have been described in detail herein, those skilled in the art will also recognize that various substitutions and modifications can be made to the systems and methods without departing from the scope and spirit of the appended claims.

What is claimed is:

1. An apparatus for pitching and splitting a concrete block comprising:

a first pitching blade configured to move in a first direction;

a second pitching blade adjacent and parallel to the first pitching blade, wherein the first pitching blade and the second pitching blade are separated by a distance that causes the concrete block to split primarily along a single plane when the first pitching blade and the second pitching blade are driven into the concrete block;

a third pitching blade opposite the first pitching blade and configured to move in a second direction; and a fourth pitching blade opposite the second pitching blade and adjacent to the third pitching blade, wherein the third pitching blade and the fourth pitching blade are separated by a distance that causes the concrete block to split primarily along the single plane, and to form at least two pitch breaks on the surface of the concrete block adjacent to the single plane and at an angle relative to the single plane.

2. The apparatus of claim 1 wherein the first pitching blade and the second pitching blade are mounted on a common blade holder.

3. The apparatus of claim 1 further comprising a conformable material disposed between the first pitching blade and a press, the conformable material allowing the first pitching blade to move relative to the surface of the concrete block when the first pitching blade comes in contact with the surface of the concrete block.

4. The apparatus of claim 1 wherein the first pitching blade and the second pitching blade are mounted on a common blade holder, and further comprising a conformable material disposed between the common blade holder and a press, the conformable material allowing the common blade holder to move relative to the surface of the concrete block.

5. The apparatus of claim 1 wherein the separation distance between the first pitching blade and the second pitching blade is different from the separation distance between the third pitching blade and the fourth pitching blade.

6. The apparatus of claim 1 wherein the third pitching blade and the fourth pitching blade are mounted on a common blade holder.

7. The apparatus of claim 1 further comprising a conformable material disposed between the third pitching blade and a surface, the conformable material allowing the third pitching blade to move relative to the surface of the concrete block.

8. The apparatus of claim 1 wherein the third pitching blade and the fourth pitching blade are mounted on a second common blade holder, and further comprising a conformable material disposed between the second common blade holder and a surface, the conformable material allowing the second common blade holder to move relative to the surface of the concrete block.

9. An apparatus for pitching and splitting a concrete block comprising:

a first pitching blade configured to move in a first direction;

a second pitching blade adjacent and parallel to the first pitching blade, wherein the first pitching blade and the second pitching blade are separated by a distance that causes the concrete block to split primarily along a single plane when the first pitching blade and the second pitching blade are driven into the concrete block;

a third pitching blade opposite the first pitching blade and configured to move in a second direction;

a fourth pitching blade opposite the second pitching blade and adjacent to the third pitching blade, wherein the third pitching blade and the fourth pitching blade are separated by a distance that causes the concrete block to split primarily along the single plane, and to form at least two pitch breaks on the surface of the concrete block adjacent to the single plane and at an angle relative to the single plane;

wherein the first pitching blade and the second pitching blade are mounted on a common blade holder; and a conformable material disposed between the common blade holder and a press.

10. The apparatus of claim 9 wherein the conformable material allows the common blade holder to move relative to the surface of the concrete block.

11. The apparatus of claim 9 wherein the separation distance between the first pitching blade and the second pitching blade is different from the separation distance between the third pitching blade and the fourth pitching blade.

12. The apparatus of claim 9 wherein the third pitching blade and the fourth pitching blade are mounted on a common blade holder.

13. The apparatus of claim 9 further comprising a conformable material disposed between the third pitching blade and a surface, the conformable material allowing the third pitching blade to move relative to the surface of the concrete block.

14. The apparatus of claim 9 wherein the third pitching blade and the fourth pitching blade are mounted on a second common blade holder, and further comprising a conformable material disposed between the second common blade holder and a surface, the conformable material allowing the second common blade holder to move relative to the surface of the concrete block.

15. An apparatus for pitching and splitting a concrete block comprising:

a first pitching blade configured to move in a first direction;

a second pitching blade adjacent and parallel to the first pitching blade, wherein the first pitching blade and the second pitching blade are separated by a distance that causes the concrete block to split primarily along a single plane when the first pitching blade and the second pitching blade are driven into the concrete block;

a third pitching blade opposite the first pitching blade and configured to move in a second direction;

a fourth pitching blade opposite the second pitching blade and adjacent to the third pitching blade, wherein the third pitching blade and the fourth pitching blade are separated by a distance that causes the concrete block to split primarily along the single plane, and to form at least two pitch breaks on the surface of the concrete block adjacent to the single plane and at an angle relative to the single plane; and a conformable material disposed between the first pitching blade and a first press and the third pitching blade and a second press, the conformable material allowing the first pitching blade and the third pitching blade to move relative to the surfaces of the concrete block when the first pitching blade and the third pitching blade come in contact with the surfaces of the concrete block.

16. The apparatus of claim 15 wherein the first pitching blade and the second pitching blade are mounted on a common blade holder.

17. The apparatus of claim 15 wherein the first pitching blade and the second pitching blade are mounted on a common blade holder, and further comprising a conformable material disposed between the common blade holder and a press, the conformable material allowing the common blade holder to move relative to the surface of the concrete block.

18. The apparatus of claim 15 wherein the separation distance between the first pitching blade and the second pitching blade is different from the separation distance between the third pitching blade and the fourth pitching blade.

19. The apparatus of claim 15 wherein the third pitching blade and the fourth pitching blade are mounted on a common blade holder.

20. The apparatus of claim 15 wherein the third pitching blade and the fourth pitching blade are mounted on a second common blade holder, and further comprising a conformable material disposed between the second common blade holder and a surface, the conformable material allowing the second common blade holder to move relative to the surface of the concrete block.

* * * * *